US007449271B2

(12) United States Patent
Kobashi et al.

(10) Patent No.: US 7,449,271 B2
(45) Date of Patent: Nov. 11, 2008

(54) ELECTROPHOTOGRAPHIC PHOTOCONDUCTOR AND METHODS THEREFOR

(75) Inventors: Masaru Kobashi, Nagano (JP); Yoichi Nakamura, Nagano (JP); Ikuo Takaki, Nagano (JP)

(73) Assignee: Fuji Electric Device Technology Co., Ltd., Tokyo (JP)

( * ) Notice: Subject to any disclaimer, the term of this patent is extended or adjusted under 35 U.S.C. 154(b) by 5 days.

(21) Appl. No.: 10/934,763

(22) Filed: Sep. 7, 2004

(65) Prior Publication Data

US 2005/0079431 A1 Apr. 14, 2005

(30) Foreign Application Priority Data

Oct. 8, 2003 (JP) ..... 2003-350001

(51) Int. Cl.
*G03G 5/05* (2006.01)

(52) U.S. Cl. ..... 430/59.6; 430/96; 430/133; 430/119.6; 430/119.71; 430/119.8

(58) Field of Classification Search ..... 430/96, 430/59.6, 125, 117, 133, 119.6, 119.71, 119.72, 430/119.8
See application file for complete search history.

(56) References Cited

U.S. PATENT DOCUMENTS 3,725,059 A * 4/1973 Komp ..... 430/117

(Continued)

FOREIGN PATENT DOCUMENTS

JP 55-058223 4/1980
JP 56-135844 10/1981

(Continued)

OTHER PUBLICATIONS

Diamond, Arthur S & David Weiss (eds.) Handbook of Imaging Materials. New York: Marcel-Dekker, Inc. (Nov. 2001) pp. 149-162 & 239-242.*

(Continued)

*Primary Examiner*—Christopher RoDee
(74) *Attorney, Agent, or Firm*—Rabin & Berdo, P.C.

(57) ABSTRACT

An electrophotographic photoconductor and method that seldom generate cracks even while recycling a photoconductor drum and peripheral members or in a liquid developing process, and thereby produce excellent images. The electrophotographic photoconductor includes a conductive substrate and a photosensitive layer comprising a charge generation material and a charge transport material. The photosensitive layer comprises a resin binder of polyarylate resin having structural units represented by the following formula (I):

(I)

In the formula, $R^1$ and $R^2$ represent a hydrogen atom, an alkyl group, a cycloalkyl group, or an aryl group. $R^1$, $R^2$, and a carbon atom bonding to the $R^1$ and $R^2$ together form a cyclic structure. The cyclic structure is bonded to no more than two arylene groups. Each of $R^3$ through $R^{10}$ being a hydrogen atom, an alkyl group, a fluorine atom, a chlorine atom, and a bromine atom. The values of m and n satisfy the equation $0.5<m/(m+n)<0.7$.

16 Claims, 1 Drawing Sheet

U.S. PATENT DOCUMENTS

| | | | | |
|---|---|---|---|---|
| 2001/0049067 | A1 * | 12/2001 | Mitsumori et al. | 430/96 |
| 2002/0090561 | A1 | 7/2002 | Nagasaka et al. | |
| 2003/0087173 | A1 * | 5/2003 | Kumano et al. | 430/96 |

FOREIGN PATENT DOCUMENTS

| | | | |
|---|---|---|---|
| JP | 61-062040 | | 3/1986 |
| JP | 61-105550 | | 5/1986 |
| JP | 07-295372 | | 11/1995 |
| JP | 08-339091 | | 12/1996 |
| JP | 09-101621 | | 4/1997 |
| JP | 10-171256 | | 6/1998 |
| JP | 10-288845 | | 10/1998 |
| JP | 10-288845 | A | 10/1998 |
| JP | 10288845 | A * | 10/1998 |
| JP | 2000-181096 | | 6/2000 |
| JP | 2000-258930 | | 9/2000 |
| JP | 2001-051432 | | 2/2001 |
| JP | 2001-192359 | | 7/2001 |
| JP | 2001-337543 | | 12/2001 |
| JP | 2002-107971 | | 4/2002 |
| JP | 2002-131942 | | 5/2002 |
| JP | 2002-148828 | | 5/2002 |
| JP | 2002-258504 | | 9/2002 |
| JP | 2002-365818 | | 12/2002 |
| JP | 2003195540 | A * | 7/2003 |
| JP | 2003-248334 | | 9/2003 |

OTHER PUBLICATIONS

Diamond, Arthur S & David Weiss (eds.) Handbook of Imaging Materials. New York: Marcel-Dekker, Inc. (Nov. 2001) pp. 145-164.*

* cited by examiner

ELECTROPHOTOGRAPHIC PHOTOCONDUCTOR AND METHODS THEREFOR

CROSS-REFERENCE TO RELATED APPLICATION

This application claims priority benefits under 35 USC § 119 of Japanese Patent Application Serial No. 2003-350001 filed on Oct. 8, 2003, the disclosure of which is incorporated by reference.

BACKGROUND OF THE INVENTION

1. Field of Invention

The invention generally relates to electrophotographic photoconductors and manufacturing methods, and particularly to photoconductors and methods principally comprising a conductive substrate and organic photosensitive layer and used in electrophotographic systems.

2. Background Art

Electrophotographic photoconductors generally comprise a photosensitive layer having a photoconductive function laminated on a conductive substrate. Recently, organic photoconductors, which use organic materials as functional components which generate and transport charge, are being actively studied and developed for copier and printer applications. Organic photoconductors have potential benefits in flexibility of material selection, high productivity, and safety.

Photoconductors generally need functions to retain surface charges in the dark, to generate charges upon receiving light, and to transport the generated charges. There are generally two types of photoconductors: a single layer type and a laminated layer type (or a function-separated type). The single layer type of photoconductor comprises a single photosensitive layer that performs all the above-mentioned functions. A photosensitive layer of the laminated layer type of photoconductor is a lamination of two function-separated layers. These include a charge generation layer principally performing the function of generating charges upon receiving light, and a charge transport layer principally performing the function of retaining surface charges in the dark and transporting the charges generated in the charge generation layer upon receiving light.

The photosensitive layer is generally formed by coating a conductive substrate with a coating liquid that is prepared by dissolving or dispersing a charge generation material and a charge transport material together with a resin binder in an organic solvent. The outermost layer of an organic photoconductor frequently comprises a resin binder of polycarbonate, which is resistant to friction between the layer surface and paper or a blade for toner removal, which is mechanically flexible, and which is transparent to the exposing light. Bisphenol Z polycarbonate is widely used as the polycarbonate resin binder. Application technologies using polycarbonate are disclosed, for example, in Japanese Unexamined Patent Application Publication Nos. S61-062040 and S61-105550.

Further, polyarylate is commonly used as a resin binder of the photosensitive layer as disclosed in Japanese Unexamined Patent Application Publication Nos. S55-058223, S56-135844, H10-288845, 2002-148828, and 2002-174920.

Studies on polyarylate have been made for improving durability and mechanical strength.

However, photoconductors comprising bisphenol Z polycarbonate resin binder, have a drawback since they are liable to generate solvent cracks or cracks due to a hand contacting on the photosensitive layer. Solvent cracks are apt to occur due to contact with cleaner solvent during cleaning of the photoconductor and the charging member. In contact charging systems in particular, large cracks occur in the photosensitive layer if the photoconductor is subjected to contact with the charging roller after cleaning and before complete volatilization of the cleaning solvent.

Environment-conscious trends are promoting a desire for recycling, and photoconductors and cartridges tend to be usually recharged and cleaned for recycling. Therefore, it has become urgent to solve the problem of solvent cracks. In a liquid development process, there is also a problem of frequent occurrence of solvent cracks because the photoconductor directly makes contact with carrier liquid dispersing toner particles. This problem also strongly needs to be solved.

To cope with this problem, Japanese Unexamined Patent Application Publication No. S61-062040 discloses use of a mixture of bisphenol A type polycarbonate resin and bisphenol Z type polyearbonate resin. Japanese Unexamined Patent Application Publication No. S61-105550 discloses use of a copolymer resin of a bisphenol A structure and a bisphenol Z structure. However, both of these disclosures do not solve the problem (see above).

It has been proposed to form a surface protection layer on the photosensitive layer for the purpose of protecting the photosensitive layer, thereby improving mechanical strength, and improving surface lubricity. Such a surface protection layer also leads to the above-mentioned problem of cracks in the surface of a photosensitive layer.

OBJECT AND SUMMARY OF THE INVENTION

Therefore, an object of the invention is to provide an improved resin binder used in the photosensitive layer, and to provide an electrophotographic photoconductor that limits generation of cracks in the process of recycling a photoconductor drum and peripheral members and in the liquid development process, and thereby produces an excellent image. Another object of the invention is to provide a method to manufacture such a photoconductor.

The inventors of the invention have studied resins that are highly resistant to solvent cracks. The inventors explored polyarylate resin types and found that the use of a resin binder of polyarylate resin with a relatively high proportion of an isophthalic acid structure achieves excellent resistance to solvent cracks and is highly soluble in a solvent suitable as a coating liquid for a photoconductor. These resin binders have been found to improve the stability of the coating liquid for photoconductors and achieve electrophotographic photoconductors with good electric performance. The invention has been accomplished based on the findings.

An electrophotographic photoconductor according to the invention comprises a conductive substrate and a photosensitive layer comprising a charge generation material and a charge transport material, wherein the photosensitive layer comprises a resin binder of polyarylate resin having structural units represented by formula (I):

(I)

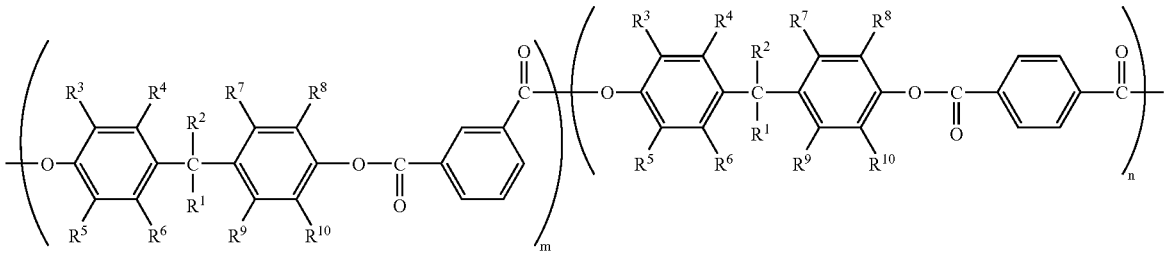

wherein, each of $R^1$ and $R^2$, being identical or different from each other, is a hydrogen atom, an alkyl group having 1 to 8 carbon atoms, a cycloalkyl group, a substituted cycloalkyl group having at least one substituent, an aryl group and an aryl group having at least one substituent;

$R^1$, $R^2$, and a carbon atom that bonds to both $R^1$ and $R^2$ form a cyclic structure that is bonded to no more than two arylene groups;

each of $R^3$ through $R^{10}$, being identical or different from each other, is a hydrogen atom, an alkyl group having 1 to 8 carbon atoms, a fluorine atom, a chlorine atom and a bromine atom; and m and n satisfy the equation $0.5<m/(m+n)<0.7$.

Advantageously, the photoconductor of the invention is a laminated layer type that comprises a charge generation layer and a charge transport layer, and the charge transport layer comprises the above-specified polyarylate resin. Preferably, the polyarylate resin is a bisphenol A type in which $R^1$ and $R^2$ in the formula (I) are methyl groups and each of $R^3$ through $R^{10}$ is a hydrogen atom. The photoconductors of the invention are preferably used in a charging process that uses a contact charging roller and most preferably used in a process to develop a photoconductor employing a liquid development process.

A method according to the invention for manufacturing an electrophotographic photoconductor comprises the steps of preparing a conductive substrate and applying, on the substrate, a coating liquid comprising at least a charge transport material and a resin binder of polyarylate resin having structural units represented by formula (I):

carbon atoms, a cycloalkyl group, a substituted cycloalkyl group having at least one substituent, an aryl group and an aryl group having at least one substituent;

$R^1$, $R^2$, and a carbon atom that bonds to both $R^1$ and $R^2$ form a cyclic structure that is bonded to no more than two arylene groups;

each of $R^3$ through $R^{10}$, being identical or different from each other, is a hydrogen atom, an alkyl group having 1 to 8 carbon atoms, a fluorine atom, a chlorine atom and a bromine atom; and m and n satisfy the equation $0.5<m/(m+n)<0.7$.

The invention uses a resin binder in a photosensitive layer, the resin binder being a polyarylate resin that comprises the above-specified structural units, and improves resistance to solvent crack formation while maintaining the electrophotographic performance of the photoconductor. Consequently, an electrophotographic photoconductor is provided that produces favorable images. The bisphenol A type polyarylate resin is particularly effective in avoiding generation of cracks. The use of polyarylate resin as a resin binder has been previously disclosed (see Japanese Unexamined Patent Application Publication Nos. S55-058223, S56-135844, H10-288845, 2002-148828, and 2002-174920). A ratio of the terephthalic acid moiety to the isophthalic acid moiety has been disclosed in Japanese Unexamined Patent Application Publication Nos. H10-288845 and 2002-148828. However, the above-mentioned disclosed Japanese Patent Documents are directed to obtaining resistance to wear or stability of a coating liquid. In contrast, this invention is directed to improvements in the resistance to the formation of solvent cracks. Therefore, this invention specifies a unique range of (I)

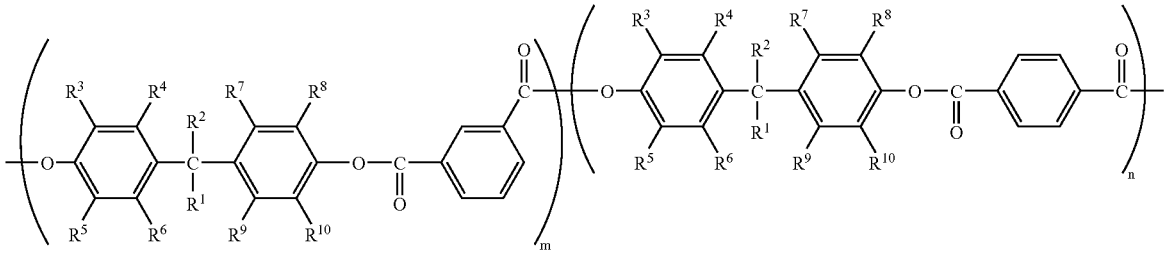

wherein each of $R^1$ and $R^2$, being identical or different from each other, is a hydrogen atom, an alkyl group having 1 to 8 the ratio of the terephthalic acid moiety to the isophthalic acid moiety in the polyarylate resin as represented (see above) by the formula (I). According to this invention such a specified polyarylate resin achieves both solvent crack resistance and favorable electric performance.

DETAILED DESCRIPTION OF THE PREFERRED EMBODIMENTS

Some preferred embodiments of the invention will be described in detail with reference to accompanying drawings in the following. It is understood that the invention, however, shall not be limited to these embodiments.

As described previously, electrophotographic photoconductors are classified into laminated layer type or function-separated type photoconductors that include negative charging laminated layer and positive charging laminated layer photoconductors, and single layer photoconductors that mainly employ a positive charging system.

Figure 1A:
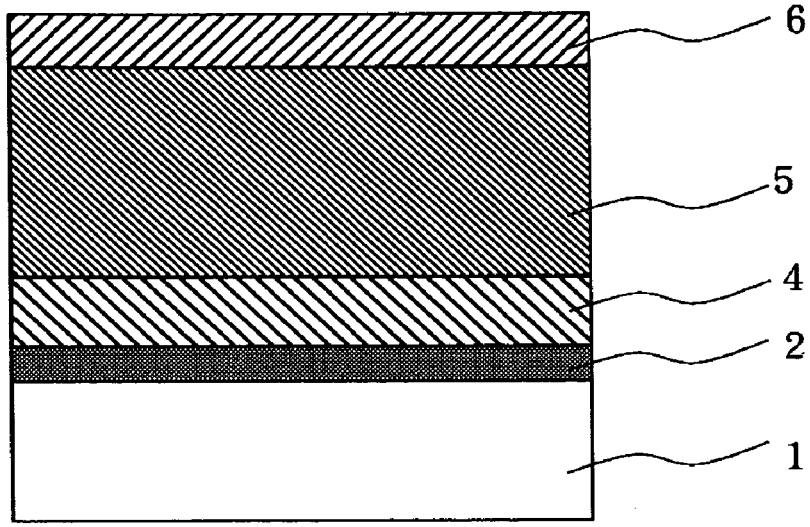
FIG. 1*a* is a schematic sectional view of an electrophotographic photoconductor comprising a negative charging function-separated laminated layer, according to the invention.
Figure 1B:
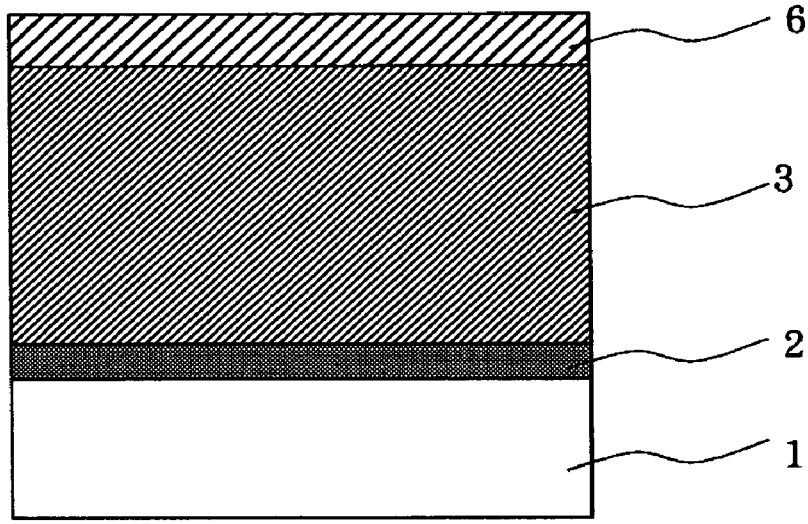
FIG. 1*b* is a schematic sectional view of an electrophotographic photoconductor comprising a positive charging single-layer laminate, according to the invention.

FIGS. 1*a* and 1*b* are schematic sectional views of electrophotographic photoconductors according to several embodiments of the invention. FIG. 1*a* shows a negative charging laminated layer photoconductor, and FIG. 1*i* b l shows a positive charging single layer photoconductor. The negative charging laminated layer photoconductor as shown in FIG. 1*a* comprises a conductive substrate 1, an undercoat layer 2 laminated to the conductive substrate 1, and a photosensitive layer consisting of a charge generation layer 4, which functions as a charge generator, and a charge transport layer 5 laminated to the undercoat layer 2. The charge transport layer 5 functions as a charge transporter. The positive charging single layer photoconductor as shown in FIG. 1*b* comprises a conductive substrate 1, an undercoat layer 2, and a single photosensitive layer 3 that functions both as a charge generator and as a charge transporter. In both types of photoconductors, an undercoat layer 2 is provided as needed. A surface protection layer 6 may be further provided on the charge transport layer 5 or on the photosensitive layer 3 as shown in FIGS. 1*a* and 1*b*, respectively.

The conductive substrate 1 functions as one electrode of the photoconductor and, at the same time, as a support member for the layers comprising the photoconductor. The conductive substrate 1 may be a cylinder, a plate, or a film. The conductive substrate may be a metal including aluminum, stainless steel, and nickel, or glass or resin, which are subjected to conductive surface treatment.

The undercoat layer 2 comprises a layer of resin or a metal oxide film such as alumite. The undercoat layer 2 is provided as needed for controlling the injection performance of charges from the conductive substrate 1 to the photosensitive layer 3, for covering surface defects on the conductive substrate 1, and for improving adhesion between the photosensitive layer 3 and the conductive substrate 1. The resin comprising the undercoat layer 2 is an insulating polymer selected from the group consisting of casein, poly(vinyl alcohol), polyaminde, melamine and cellulose, and a conductive polymer selected from the group consisting of polythiophene, polypyrrole and polyaniline. These resins may be used alone or in a mixture of an appropriate combination. The resin may further comprise a metal oxide such as titanium dioxide or zinc oxide.

The charge generation layer 4, which generates charges when activated by light, may be formed by applying a coating liquid containing particles of charge generating material dispersed in the resin binder. It is desirable for the charge generation layer 4 to exhibit high charge generation efficiency. Injection performance of the generated charges into the charge transport layer 5 is also important, that is, little dependence on electric field and sufficient injection at low electric field are desirable. The charge generation layer 4 may comprise a phthalocyanine compound selected from the group consisting of X-type metal-free phthalocyanine, τ-type metal-free phthalocyanine, α-type titanylphthalocyanine, β-type titanylphthalocyanine, Y-type titanylphthalocyanine, γ-type titanylphthalocyanine, amorphous titanylphthalocyanine and ϵ-type copper phthalocyanine, and a pigment selected from the group consisting of azo pigment, anthanthrone pigment, thiapyrylium pigment, perylene pigment, perynone pigment, squarilium pigment, and quinacridone pigment. These compounds and pigments may be used alone or in appropriate combination. Suitable compounds and pigments may be selected according to the wavelength range of the exposing light source used for image formation.

Since the charge generation layer 4 only needs to provide a charge generating function, a thickness of the charge generation layer 4 may be determined from the light absorption coefficient of the materials comprising the charge generation layer 4. An appropriate thickness is generally below 1 μm, and preferably less than 0.5 μm. The charge generation layer 4 may further comprise a charge generation additive. A resin binder for the charge generation layer 4 may be at least one polymer and at least one copolymer selected from the group consisting of polycarbonate resin, polyester resin, polyamide resin, polyurethane resin, poly(vinyl chloride) resin, poly (vinyl acetate) resin, phenoxy resin, poly(vinyl acetal) resin, poly(vinyl butyral) resin, polystyrene resin, polysulfone resin, diarylphthalate resin and methacrylate resin, and appropriate combinations thereof.

The charge transport layer 5 comprises charge transport material and a resin binder. The resin binder of the charge transport layer 5 of the invention must be a polyarylate resin having the structural unit represented by formula (I). The specified resin accomplishes the objectives of the invention. Bisphenol A type polyarylate resin, in particular, is effective in avoiding generation of cracks. The polyarylate resin defined by formula (I) can be used alone or in combination with a polycarbonate resin selected from the group consisting of bisphenol A type polycarbonate resin, bisphenol Z type polycarbonate resin, bisphenol A-bisphenyl copolymer and bisphenol Z-biphenyl copolymer, or in combination with polystyrene resin or polyphenylene resin. The polyarylate resin defined by formula (I) preferably comprises 1 wt % to 100 wt % of the resin binder of the charge transport layer 5, and more preferably 20 wt % to 80 wt % of the resin binder of the charge transport layer 5.

Specific examples of the polyarylate resin having the structural unit represented by formula (I) are shown by the following formulas (I-1) through (I-10). It is understood that the polyarylate resin of this invention is not limited to these examples.

(I-1)
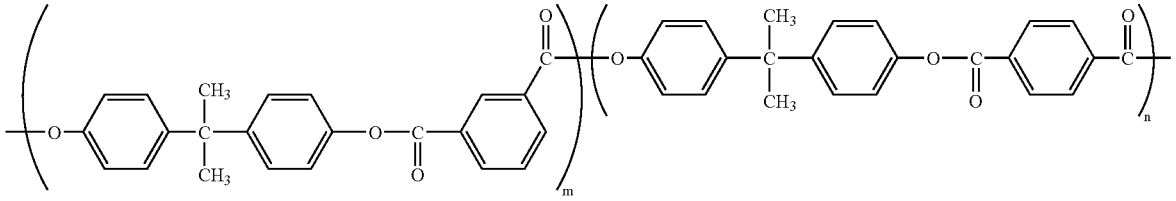
(I-2)
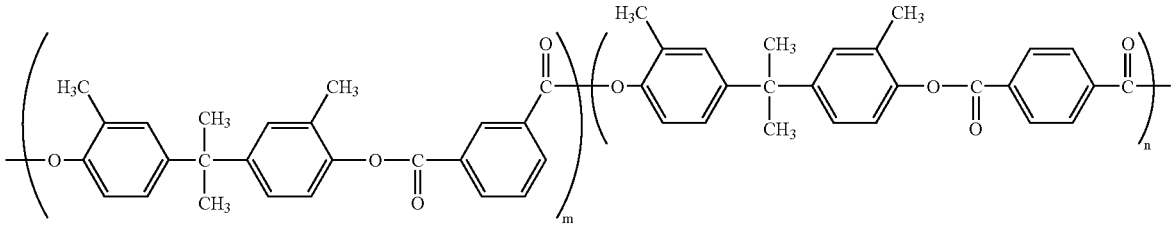
(I-3)
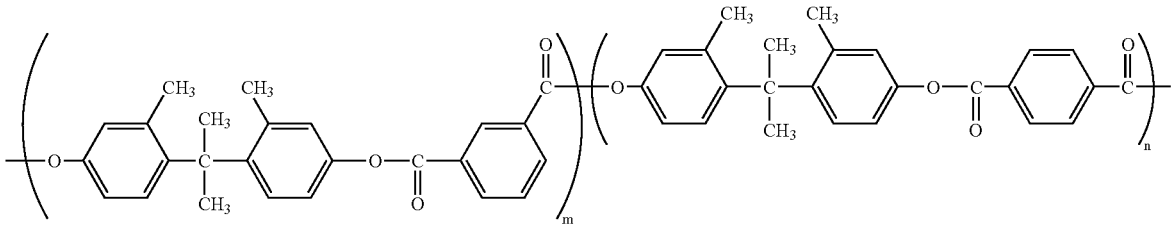
(I-4)
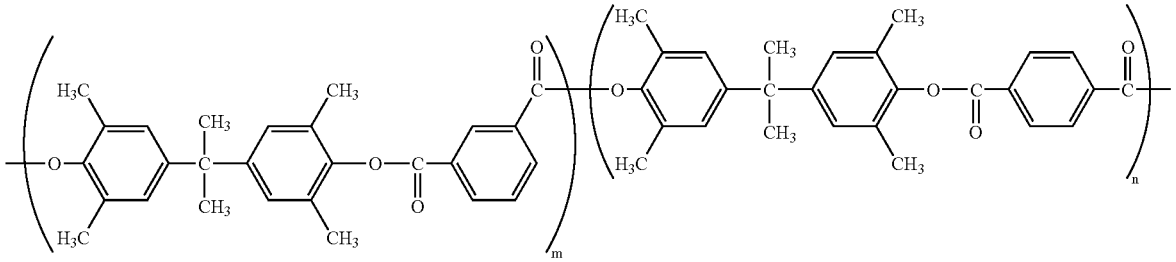
(I-5)
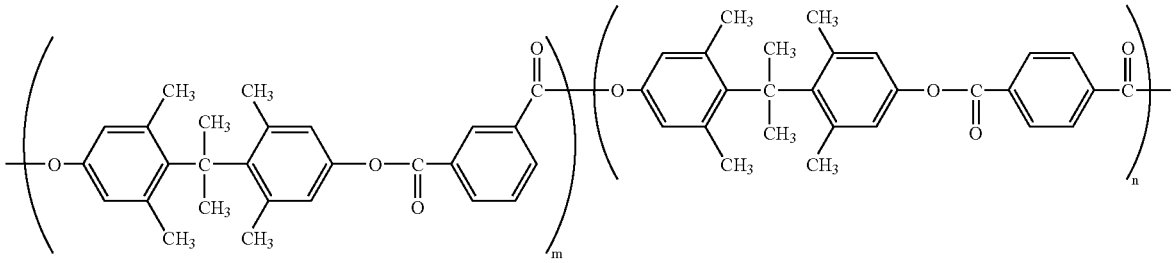
(I-6)
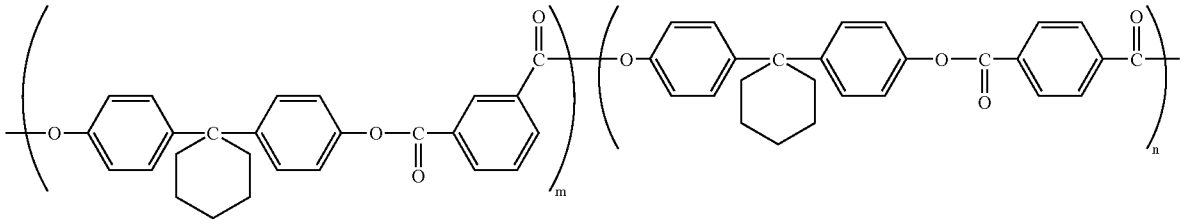

-continued (I-7)

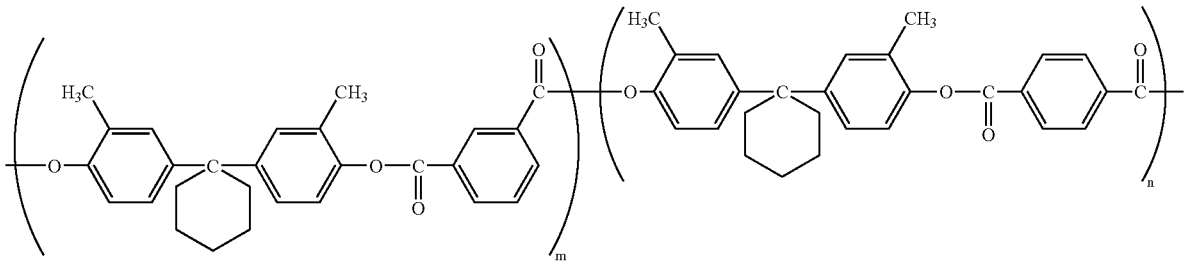

(I-8)

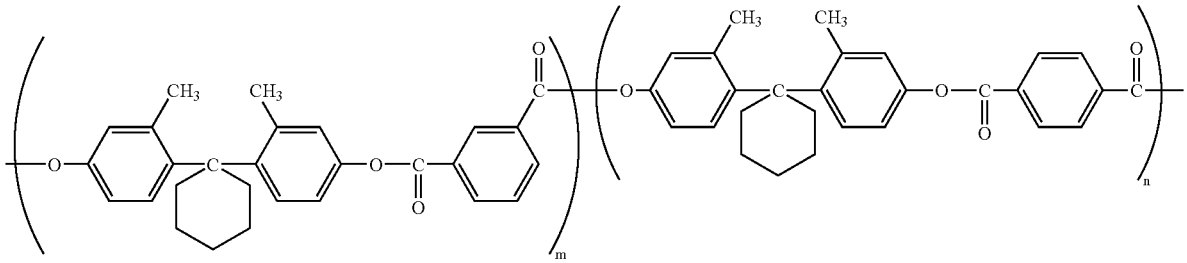

(I-9)

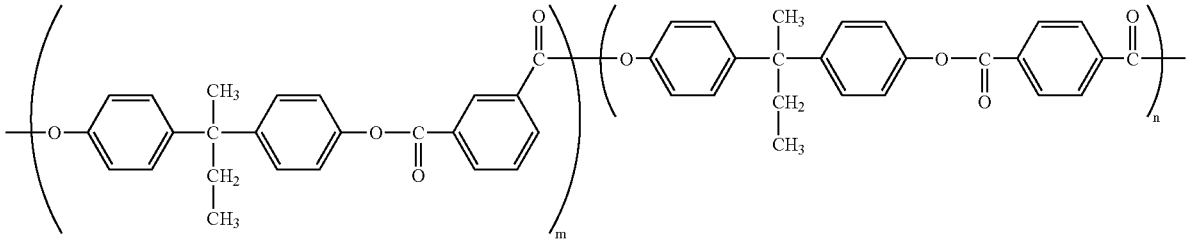

(I-10)

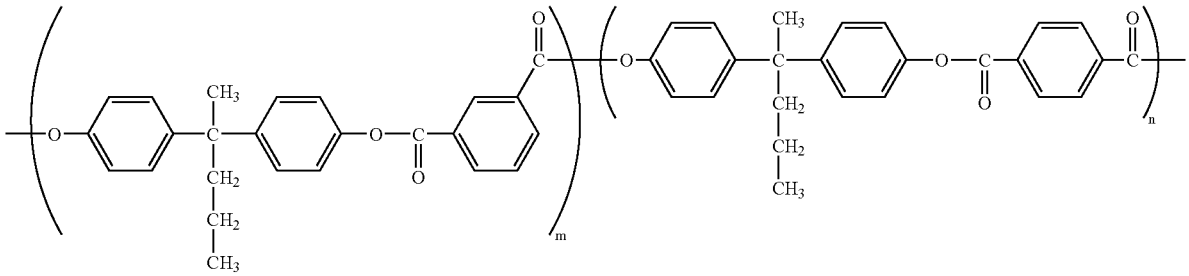

The charge transport material of the charge transport layer 5 may be selected from group consisting of hydrazone compounds, styryl compounds, diamine compounds, butadiene compounds and indole compounds. The compounds can be used alone or in a mixture of an appropriate combination. Specific examples of the charge transport material are shown by the following formulas (II-1) through (II-13), though the charge transport material is not limited to those compounds.

(II-1)
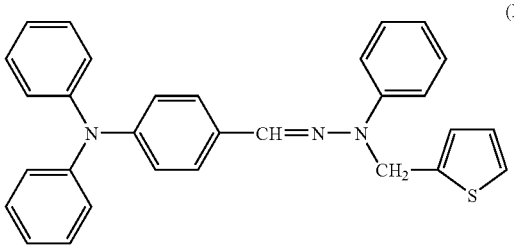
(II-2)
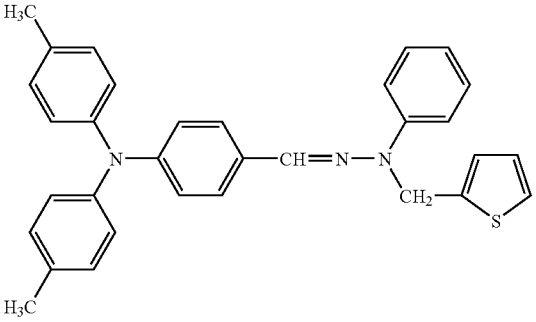
(II-3)
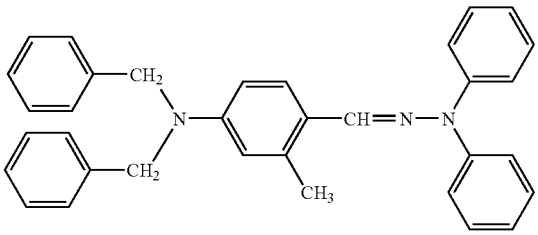
(II-4)
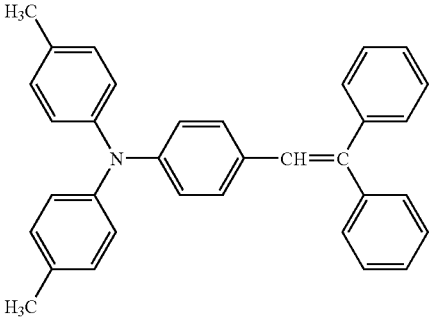
-continued
(II-5)
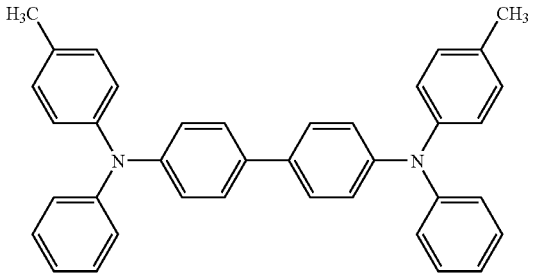
(II-6)
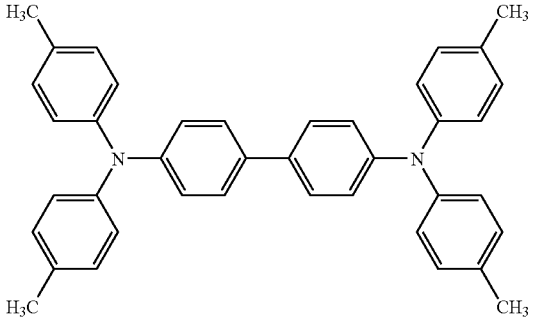
(II_7)
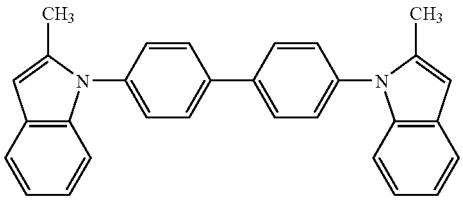
(II-8)
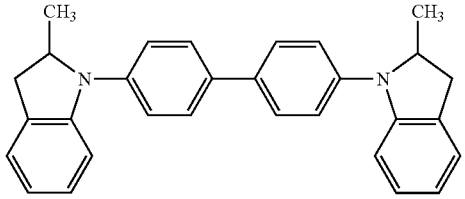
(II-9)
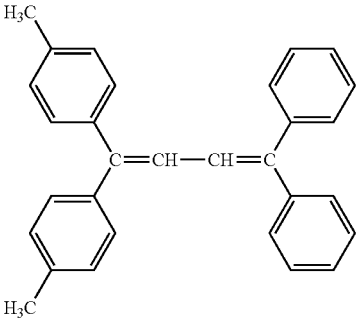
(II-10)
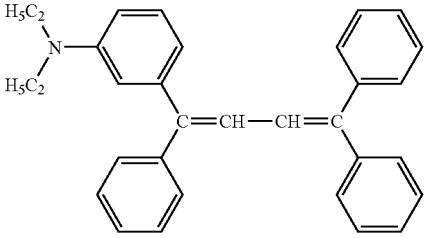

-continued (II-11)

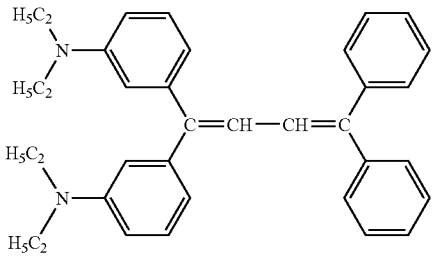

(II-12)

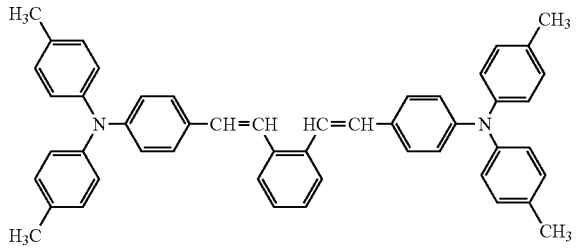

(II-13)

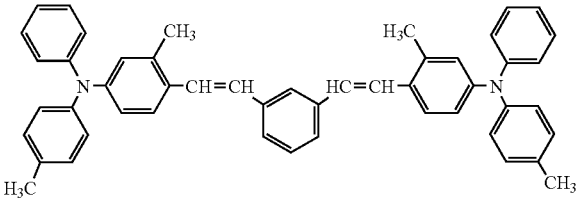

The thickness of the charge transport layer 5 is preferably 3 to 50 μm and more preferably 15 to 40 μm for maintaining an effective surface potential.

The single layer type photosensitive layer 3 comprises a charge generation material; a hole transport material; an electron transport material, which is a compound with acceptor properties; and a binder resin.

The charge generation material in a single layer type photosensitive layer 3 can be selected from the group consisting of phthalocyanine pigment, azo pigment, anthanthrone pigment, perylene pigment, perynone pigment, polycyclic quinone pigment, squarilium pigment, thiapyrylium pigment and quinacridone pigment. These charge generation materials may be used alone or in a combination of two or more materials. An electrophotographic photoconductor of the invention achieves remarkable improvement in sensitivity, durability, and image quality when the charge generation material is selected from the group consisting of azo pigments of both bisazo pigment and trisazo pigment, perylene pigment of N,N'-bis(3,5-dimethylphenyl)- 3,4:9,10-perylene bis(carboximide), phthalocyanine pigments of metal-free phthalocyanine, copper phthalocyanine, and titanylphthalocyanine. More specifically, the phthalocyanine is selected from the group consisting of X-type metal-free phthalocyanine, τ-type metal-free phthalocyanine, ϵ-type copper phthalocyanine, α-type titanylphthalocyanine, β-type titanylphthalocyanine, Y-type titanylphthalocyanine, amorphous titanylphthalocyanine and titanylphthalocyanine that shows a maximum peak at 9.6° of Bragg angle 2θ in a CuKα X-ray diffraction spectrum as disclosed in Japanese Unexamined Patent Application Publication No. H8-209023. The amount of the charge generation substance is preferably 0.1 to 20 wt % and more preferably 0.5 to 10 wt % with respect to the solid components of the photosensitive layer 3.

The hole transport material may be selected from the group consisting of hydrazone compound, pyrazoline compound, pyrazolone compound, oxadiazole compound, oxazole compound, arylamine compound, benzidine compound, stylbene compound, styryl compound, poly-N-vinylcarbazole and polysilane. These hole transport materials can be used alone or in an appropriate combination of two or more materials. The hole transport material used in the invention is desirable when the material is suitable for combination with a charge generation material as well as having good transport ability of holes that are generated on light irradiation. The amount of the hole transport material is preferably in the range of 5 to 80 wt % and more preferably in the range of 10 to 60 wt % with respect to the solid components of the photosensitive layer 3.

The electron transport material, that is, an acceptor compound, may be selected from the group consisting of succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinonedimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compound, quinone compound, benzoquinone compound, diphenoquinone compound, naphthoquinone compound, anthraquinone compound, stilbenequinone compound and azoquinone compound. These electron transport materials may be used alone or in a combination of two or more materials. The amount of the electron transport material is preferably in the range of 1 to 50 wt % and more preferably in the range of 5 to 40 wt % with respect to the solid components of the photosensitive layer 3.

The resin binder for a single layer type photosensitive layer 3 may be the polyarylate resin defined by formula (I) alone or this polyarylate resin in an appropriate combination with a polymer or a copolymer that is selected from the group consisting of polyester resin, poly(vinyl acetal) resin, poly(vinyl butyral) resin, poly(vinyl alcohol) resin, poly(vinyl chloride) resin, poly(vinyl acetate) resin, polyethylene, polypropylene, acrylic resin, polyurethane resin, epoxy resin, melamine resin, silicone resin, polyamide resin, polystyrene resin, polyacetal resin, polyarylate resin, polysulfone resin and polymethacrylate. These compounds may be used alone or in an appropriate combination including copolymers of these compounds. The same type of resins with different molecular weights may be used in a mixture. The amount of the resin binder is preferably in a range of 10 to 90 wt % and more preferably in a range of 20 to 80 wt % with respect to the solid components of the photosensitive layer 3. The proportion of the polyarylate resin defined by formula (I) in the resin binder of the photosensitive layer 3 is preferably in a range of 1 to 100 wt % and more preferably in a range of 20 to 80 wt % with respect to the solid components of the photosensitive layer 3.

The thickness of the photosensitive layer 3 is preferably in a range of 3 to 100 μm and preferably in a range of 10 to 50 μm to maintain an effective surface potential.

The photosensitive layer of both the laminated layer type and the single layer type may comprise an agent for suppressing degradation such as an antioxidant or a photostabilizer for improving stability in a severe environment or harmful light. Compounds for such purposes include derivatives of chromanol such as tocopherol, esterified compounds, poly(aryl alkane) compounds, hydroquinone derivatives, etherified compounds, dietherified compounds, benzophenone derivatives, benzotriazole derivatives, thioether compounds, phenylenediamine derivatives, phosphonic esters, phosphites, phenol compounds, hindered phenol compounds, straight chain amine compounds, cyclic amine compounds and hindered amine compounds.

The photosensitive layer 3 may comprise a leveling agent such as silicone oil or fluorine oil for the purpose of improving the leveling quality of the formed film and providing lubrication. The photosensitive layer 3 may further comprise, for the purpose of reducing the friction coefficient or providing lubricity, fine particles of metal oxide such as silicon oxide (silica), titanium oxide, zinc oxide, calcium oxide, and aluminum oxide (alumina), or zirconium oxide, a metal sulfate such as barium sulfate or calcium sulfate, metal nitride such as silicon nitride or aluminum nitride, particles of fluorine resin such as ethylene tetrafluoride resin, or comb-type fluorine-containing graft copolymer resin. Other known additives may be further included in the photosensitive layer 3 as required, as long as no substantial deterioration occurs in electrophotographic performance.

EXAMPLES OF EMBODIMENTS

Specific and non-limiting examples of several embodiments of the invention are described in more in detail as follows. However, it is understood that the invention is not limited to these specific examples.

Manufacture of Polyarylate Resin

Manufacturing Example 1

A Manufacturing Method for Polyarylate Resin A

Ion-exchanged water 720 mL, NaOH 17.2 g, p-tert-butylphenol 0.12 g, bisphenol A 45.6 g, and tetrabutylammonium bromide 0.06 g were put into a four-port 2 liter flask. Terephthalic acid chloride 18.27 g and isophthalic acid chloride 22.33 g were dissolved in 720 mL of methylene chloride. This solution was put into the four-port flask in about 2 minutes, and then stirred for one and a half hours to promote chemical reaction. After completion of the reaction, the solution was diluted with 480 mL of methylene chloride. The aqueous phase was separated and reprecipitated with a four-fold volume of acetone. After air-drying overnight, the obtained raw material was dissolved in methylene chloride to make a 5% solution, which was then rinsed with ion-exchanged water. The reacted liquid was dropped into a four-fold volume of acetone that was vigorously agitated to cause reprecipitation. The precipitated substance was gathered by filtration and dried at 60° C. overnight, to obtain the target polymer. The polystyrene-converted weight average molecular weight of the obtained polyarylate resin A was 108,800. The structural formula of the polyarylate resin A so obtained is shown below:

(I)

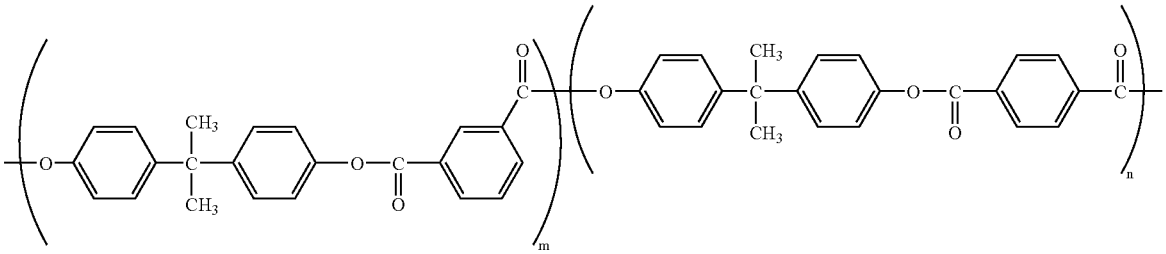

m:n = 55:45

Manufacturing Example 2

Manufacturing Method for Polyarylate Resin B

Polyarylate resin B was manufactured in the same manner as described for Manufacturing Example 1 except that the quantity of the terephthalic acid chloride was 16.24 g and the quantity of the isophthalic acid chloride was 24.36 g. The polystyrene-converted weight average molecular weight of the obtained polyarylate resin B was 103,200. The structural formula of the polyarylate resin B so obtained is shown below:

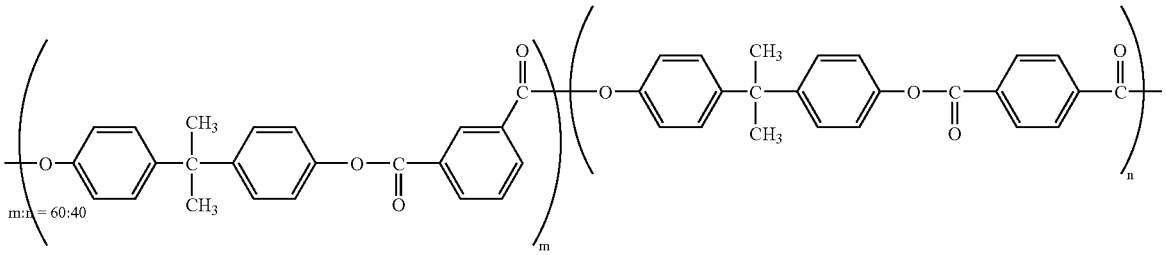

m:n = 60:40

Manufacturing Example 3

Manufacturing Method for Polyarylate Resin C

Polyarylate resin C was manufactured in the same manner as described for Manufacturing Example 1 except that the quantity of the terephthalic acid chloride was 14.21 g and the quantity of the isophthalic acid chloride was 26.39 g. The polystyrene-converted weight average molecular weight of the obtained polyarylate resin C was 94,800. The structural formula of the polyarylate resin C so obtained is shown below:

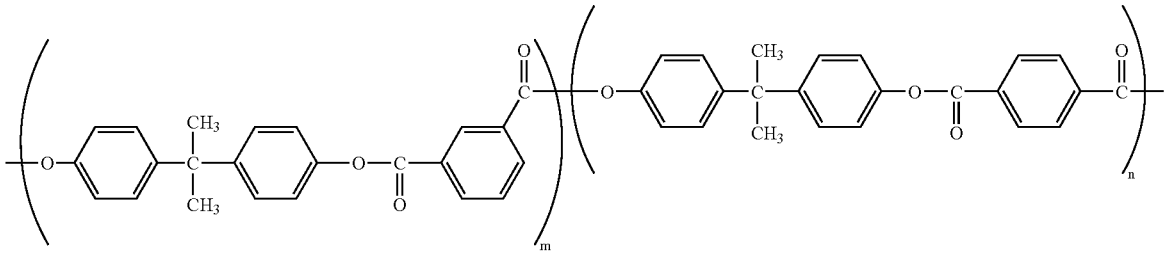

m:n = 65:35

Manufacturing Example 4

Manufacturing Method for Polyarylate Resin D

Polyarylate resin D was manufactured in the same manner as described for Manufacturing Example 1 except that the quantity of the terephthalic acid chloride was 9.14 g and the quantity of the isophthalic acid chloride was 27.41 g. The polystyrene-converted weight average molecular weight of the obtained polyarylate resin D was 100,800. The structural formula of the polyarylate resin D so obtained is shown below:

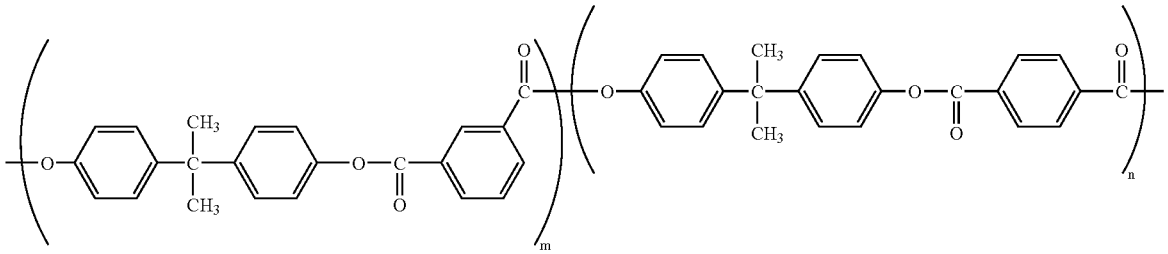

m:n = 75:25

Manufacturing Example 5

Manufacturing Method for Polyarylate Resin E

Polyarylate resin E was manufactured in the same manner as described for Manufacturing Example 1 except that the quantity of the terephthalic acid chloride was 12.18 g and the quantity of the isophthalic acid chloride was 28.42 g. The polystyrene-converted weight average molecular weight of the obtained polyarylate resin E was 114,300. The structural formula of the polyarylate resin E so obtained is shown below:

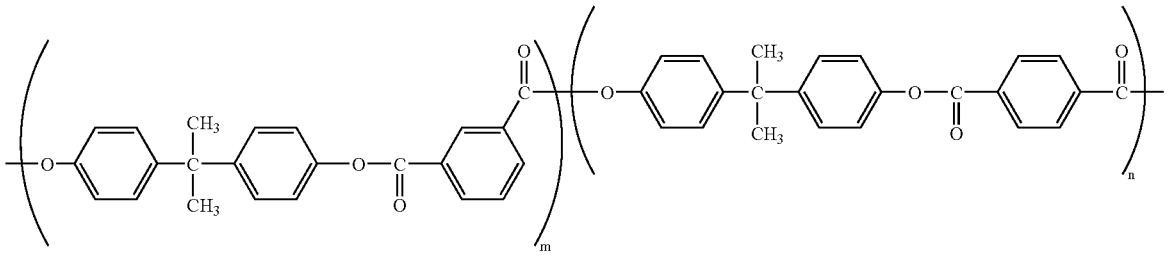

m:n = 70:30

Manufacturing Example 6

Manufacturing Method for Polyarylate Resin F

Polyarylate resin F was manufactured in the same manner as described for Manufacturing Example 1 except that the quantity of the terephthalic acid chloride was 20.3 g and the quantity of the isophthalic acid chloride was 20.3 g. The polystyrene-converted weight average molecular weight of the obtained polyarylate resin F was 96,000. The structural formula of the polyarylate resin F so obtained is shown below:

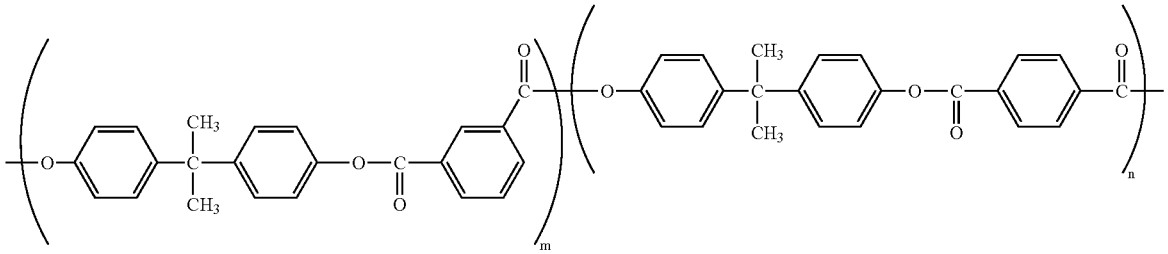

m:n = 50:50

Manufacturing Example 7

Manufacturing Method for Polyarylate Resin G

Polyarylate resin G was manufactured in the same manner as described for Manufacturing Example 1 except that the quantity of the terephthalic acid chloride was 22.33 g and the quantity of the isophthalic acid was 18.27 g. The polystyrene-converted weight average molecular weight of the obtained polyarylate resin G was 92,700. The structural formula of the polyarylate resin G so obtained is shown below:

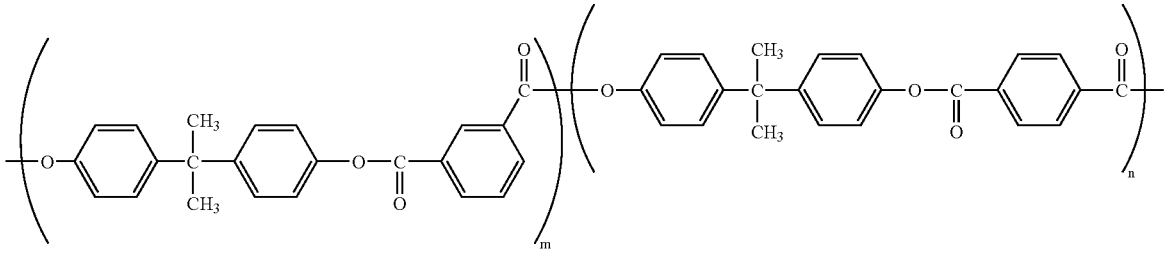

m:n = 45:55

Manufacture of Photoconductors

Example 1 (Ex 1)

A coating liquid for an undercoat layer 2 was prepared by dissolving and dispersing 5 parts by weight of alcohol-soluble nylon, CM8000 (trade name) manufactured by Toray Industries Inc., and b 5 l parts by weight of fine particles of aminosilane-treated titanium oxide in 90 parts by weight of methanol. The exterior of a conductive substrate 1 of an aluminum cylinder was dip-coated with this coating liquid and dried at 100° C. for 30 min to form the undercoat layer 2 with a thickness of 3 μm.

A coating for a charge generation layer 4 was prepared by dissolving and dispersing 1 part by weight of a charge generation material of a metal-free phthalocyanine as shown below

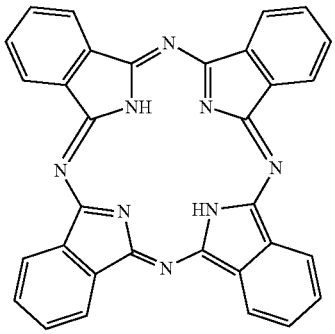

and 1.5 parts by weight of a resin binder of poly(vinyl butyral) resin, SLEC KS-1 (trade name) manufactured by Sekisui Chemical Co., Ltd., in 60 parts by weight of dichloromethane. This coating liquid was applied onto the undercoat layer 2 by a dip-coating method and dried at 80° C. for 30 min to form a charge generation layer 4 with a thickness of 0.3 μm.

A coating liquid for a charge transport layer 5 was prepared by dissolving 90 parts by weight of a charge transport material of a stilbene compound as shown below,

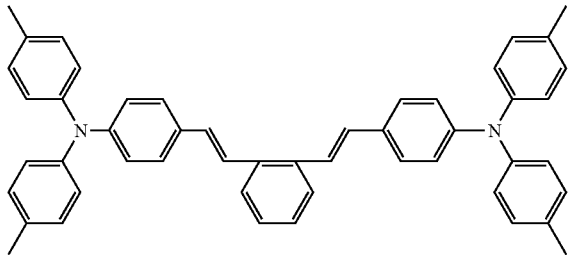

and 110 parts by weight of a resin binder of polyarylate resin A manufactured by Manufacturing Example 1 in 1,000 parts by weight of dichloromethane. This coating liquid was applied onto the charge generation layer 4 by a dip-coating method and dried at 90° C. for 60 min to form a charge transport layer 5 with a thickness of 25 μm. Thus, an organic electrophotographic photoconductor was manufactured.

Example 2 (Ex 2)

An organic electrophotographic photoconductor was manufactured in the same manner as described in Example 1 except that polyarylate resin A manufactured by Manufacturing Example 1 and used in Example 1 was replaced by polyarylate resin B manufactured by Manufacturing Example 2.

Example 3 (Ex 3)

An organic electrophotographic photoconductor was manufactured in the same manner as in Example 1 except that polyarylate resin A manufactured by Manufacturing Example 1 and used in Example 1 was replaced by polyarylate resin C manufactured by Manufacturing Example 3.

Example 4 (Ex 4)

An organic electrophotographic photoconductor was manufactured in the same manner as in Example 1 except that the metal-free phthalocyanine used for a charge generation material in Example 1 was replaced by titanylphthalocyanine.

Example 5 (Ex 5)

An organic electrophotographic photoconductor was manufactured in the same manner as in Example 1 except that the stilbene compound used for a charge transport material in Example 1 was replaced by the compound represented by the formula (II-6).

Comparative Example 1 (C Ex 1)

An organic electrophotographic photoconductor was manufactured in the same manner as in Example 1 except that the polyarylate resin A used in Example 1 was replaced by polyarylate resin D manufactured by Manufacturing Example 4.

Comparative Example 2 (C Ex 2)

An organic electrophotographic photoconductor was manufactured in the same manner as in Example 1 except that the polyarylate resin A used in Example 1 was replaced by polyarylate resin E manufactured by Manufacturing Example 5.

Comparative Example 3 (C Ex 3)

An organic electrophotographic photoconductor was manufactured in the same manner as in Example 1 except that the polyarylate resin A used in Example 1 was replaced by polyarylate resin F manufactured by Manufacturing Example 6.

Comparative Example 4 (C Ex 4)

An organic electrophotographic photoconductor was manufactured in the same manner as in Example 1 except that the polyarylate resin A used in Example 1 was replaced by polyarylate resin G manufactured by Manufacturing Example 7.

Comparative Example 5 (C Ex 5)

An organic electrophotographic photoconductor was manufactured in the same manner as in Example 1 except that the polyarylate resin A used in Example 1 was replaced by polyarylate resin F manufactured by Manufacturing Example 6 and the metal-free phthalocyanine used for a charge generation material in Example 1 was replaced by titanylphthalocyanine.

Comparative Example 6 (C Ex 6)

An organic electrophotographic photoconductor was manufactured in the same manner as in Example 1 except that the polyarylate resin A used in Example 1 was replaced by polyarylate resin F manufactured by Manufacturing Example 6 and the stilbene compound used for a charge transport material in Example 1 was replaced by the compound represented by the formula (II-6).

Example 6 (Ex 6)

A coating liquid for an undercoat layer was prepared by stirring and dissolving 5 parts by weight of vinyl chloride-vinyl acetate-vinyl alcohol copolymer, SOLBIN A (trade name) manufactured by Nisshin Chemical Industry Co., Ltd., in 95 parts by weight of methylethyl ketone. The exterior of a conductive substrate 1 of an aluminum cylinder was dip-coated with this coating liquid and dried at 100° C. for 30 min to form an undercoat layer 2 with a thickness of 0.2 μm.

A coating liquid for a photosensitive layer was prepared by dissolving and dispersing 2 parts by weight of a charge generation material of a metal-free phthalocyanine as shown below,

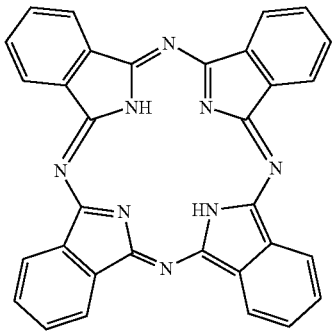

65 parts by weight of a hole transport material of the stilbene compound as shown below,

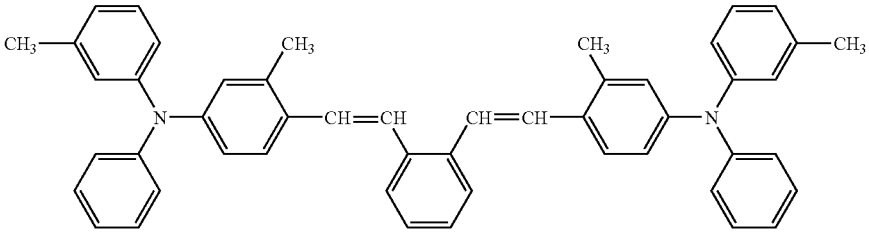

28 parts by weight of an electron transport material of the compound as shown below,

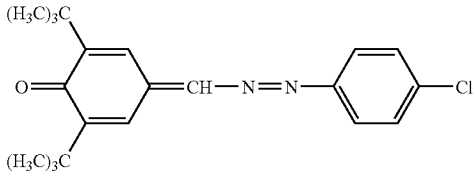

and 105 parts by weight of the resin binder of the polyarylate resin A manufactured by Manufacturing Example 1 in 1,000 parts by weight of dichloromethane. This coating liquid was applied onto the undercoat layer 2 by a dip-coating method and dried at 100° C. for 60 min to form a photosensitive layer with a thickness of 25 μm. Thus, an electrophotographic photoconductor was manufactured.

Comparative Example 7 (C Ex 7)

An electrophotographic photoconductor was manufactured in the same manner as in Example 6 except that the polyarylate resin A manufactured by Manufacturing Example 1 and used in Example 6 was replaced by polyarylate resin G manufactured by Manufacturing Example 7.

Evaluation of Photoconductors

Resistance to the occurrence of solvent cracks and electrical performances were evaluated on Examples 1 through 6 and Comparative Examples 1 through 7. In addition, dissolving property was also evaluated by observing the dissolved state of the polyarylate resin in the process of preparing a coating liquid for a charge transport layer.

Evaluation of Resistance to Occurrence of Solvent Cracks (1) Kerosene-Bath Immersion Test Each of the photoconductors was immersed in kerosene, manufactured by Wako Pure Chemical Industries Co., Ltd., at 23° C. and 50% RH for 5 min. After pulling each of the photoconductors from the kerosene, the kerosene was wiped off and the photoconductor was mounted on a laser printer. Whole-black printing was carried out on the printer. Since crack generation spots can be observed by white lines in the whole-black printing image, the number of the white lines was counted. The results are shown in Table 1 (see below).

Evaluation of Resistance to Occurrence of Solvent Cracks (2) Immersion Test in a Carrier Liquid for The Liquid Development Process Each of the photoconductors was immersed in a carrier liquid for the liquid development process (comprising mainly isoparaffin solvent) at 50° C. and 85% RH for 5 days. After pulling the samples out of the isoparaffin solvent, visual inspection was carried out for generation of cracks on the immersed samples. The results are shown in Table 1 (see below).

Electrical Performance

Each of the laminated layer type photoconductors of Examples 1 through 5 and Comparative Examples 1 through 6 was charged to −650 V by corona discharge in the dark and surface potential $V_0$ was measured immediately after charging. After leaving samples for 5 sec in the dark, surface potential $V_5$ was measured to obtain a charge retention rate in 5 sec $V_{k5}$ (%) defined by equation (1).

$$V_{k5}=V_5/V_0\times 100 \quad (1)$$

The photoconductor was irradiated by light at a wavelength of 780 nm that is spectroscopically separated out of light from a light source of a halogen lamp by a filter, for 5 sec after the time when the surface potential was −600 V. Measurements were made for light energy $E_{1/2}$ (μJ/cm$^2$) that was irradiated in the interval until the surface potential decayed to −300 V from −600 V and light energy $E_{50}$ (μJ/cm$^2$) that was irradiated in the interval until the surface potential decayed to −50 V from −600 V. The results are shown in Table 1 (see below).

As for the single layer type photoconductors of Example 6 and Comparative Example 7, the conductor surface was initially charged to 650 V by corona discharge in the dark and surface potential $V_0$ was measured immediately after charging. After leaving samples for 5 sec in the dark, surface potential $V_5$ was measured to obtain charge retention rate $V_{k5}$ (%) defined by the equation (1) (see above).

The photoconductor was irradiated by light at a wavelength of 780 nm that is spectroscopically separated out of light from a light source of a halogen lamp by a filter, for 5 sec after the time when the surface potential was 600 V. Measurements were made for light energy $E_{1/2}$ (μJ/cm$^2$) that was irradiated in the interval until the surface potential decayed to 300 V from 600 V and light energy $E_{50}$ (μJ/cm$^2$) that was irradiated in the interval until the surface potential decayed to 50 V from 600 V. The results are shown in Table 1(see below).

TABLE 1

| | solubility (*1) | solvent crack resistance: kerosene immersion (cracks/cm$^2$) | solvent crack resistance: carrier liquid immersion (*2) | electric performance: $Vk_5$ (%) | electric performance: $E_{1/2}$ (μJ/cm$^2$) | electric performance: $E_{50}$ (μJ/cm$^2$) |
|---|---|---|---|---|---|---|
| Ex 1 | ○ | 2 | absent | 95 | 0.35 | 2.14 |
| Ex 2 | ○ | 3 | absent | 95 | 0.34 | 2.06 |
| Ex 3 | ○ | 4 | absent | 95 | 0.35 | 2.08 |
| Ex 4 | ○ | 3 | absent | 94 | 0.14 | 1.05 |
| Ex 5 | ○ | 1 | absent | 94 | 0.30 | 1.89 |
| C Ex 1 | □ | 12 | exist | 91 | 0.54 | 4.65 |
| C Ex 2 | ○ | 10 | exist | 93 | 0.39 | 2.86 |
| C Ex 3 | ○ | 15 | exist | 95 | 0.35 | 2.02 |
| C Ex 4 | ○ | 19 | exist | 95 | 0.35 | 2.05 |
| C Ex 5 | ○ | 11 | exist | 94 | 0.14 | 0.98 |
| C Ex 6 | ○ | 8 | absent | 94 | 0.31 | 2.02 |
| Ex 6 | ○ | 7 | absent | 90.2 | 1.05 | 6.84 |
| C Ex 7 | ○ | 23 | exist | 89.5 | 1.03 | 5.68 |

(*1) meaning of symbols
○ dissolved homogeneously
□ partly undissolved
x practically undissolved
(*2) immersion in carrier liquid for liquid development process, indicating existence of cracks As is apparent from Table 1 (see above), the photoconductors of Examples 1 through 5 exhibited favorable results with a small number of cracks and without degradation of electric performance. In contrast, Comparative Example 1 showed a problem when the dissolving property was evaluated and resulted in degraded electric performance. Comparative Examples 2 through 6 showed no problems in electrical performance, but revealed the drawback of large number of cracks. As for the single layer type photoconductors of Example 6 and Comparative Example 7, while Example 6 exhibited acceptable results in all of the dissolving properties the solvent crack resistance, and electric performance. Comparative Example 7 revealed significantly larger number of cracks. Thus, in single layer type photoconductors, a photoconductor according to the invention is superior to prior art laminated layer type photoconductors.

As described above, it has been demonstrated that an electrophotographic photoconductor exhibiting excellent resistance against occurrence of solvent cracks is provided without degradation of electric performance by using polyarylate resins according to the invention.

What is claimed is:

1. A photoconductor for electrophotography having resistance to solvent cracking upon exposure to at least one of liquid developers and cleaning solvents, the photoconductor comprising:

a conductive substrate; and a photosensitive layer comprising a charge generation material, a charge transport material, and a resin binder comprised of polyarylate resin having structural units represented by formula (I):

(I)

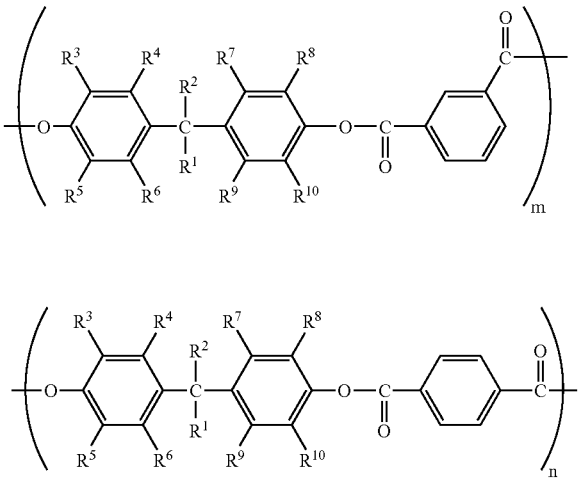

wherein each of $R^1$ and $R^2$, being identical or different from each other, is a hydrogen atom, an alkyl group having 1 to 8 carbon atoms, a cycloalkyl group, a substituted cycloalkyl group having at least one substituent, an aryl group and an aryl group having at least one substituent;

wherein $R^1$, $R^2$, and a carbon atom that bonds to both $R^1$ and $R^2$, form a cyclic structure that is bonded to no more than two arylene groups;

wherein each of $R^3$ through $R^{10}$, being identical or different from each other, is a hydrogen atom, an alkyl group having 1 to 8 carbon atoms, a fluorine atom, a chlorine atom and a bromine atom; and wherein m and n satisfy the equation $0.55 \leqq m/(m+n) \leqq 0.65$.

2. The photoconductor according to claim 1, wherein the photosensitive layer comprises a charge generation layer and a charge transport layer, and the charge transport layer comprises the polyarylate resin.

3. The photoconductor according to claim wherein $R^1$ and $R^2$ are methyl groups and $R^3$ through $R^{10}$ are hydrogen atoms.

4. The photoconductor according to claim 1, wherein the resin binder comprised of polyarylate resin has structural units represented by the following formula (1-2):

(I-2)

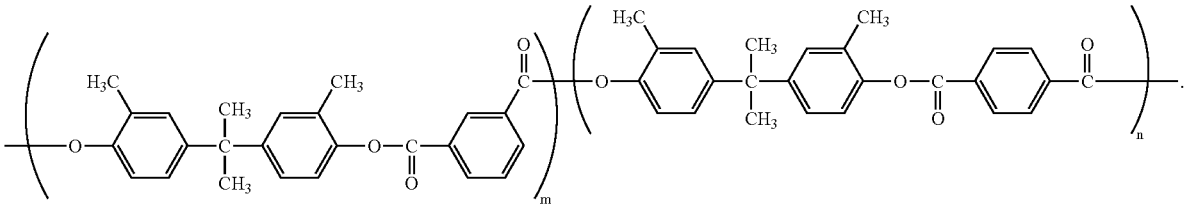

5. A method of preparing a photoconductor for electrophotography having a photosensitive layer which is a single layer and having resistance to solvent cracking upon exposure to at least one of liquid developers and cleaning solvents, comprising the steps of:

preparing a conductive substrate;

applying to the conductive substrate a liquid coating comprised of a charge generating material, a charge transport material and a resin binder comprised of polyarylate resin having structural units represented by formula (I):

(I)

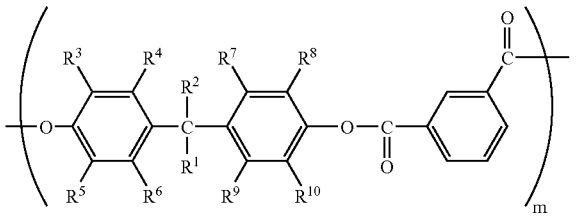

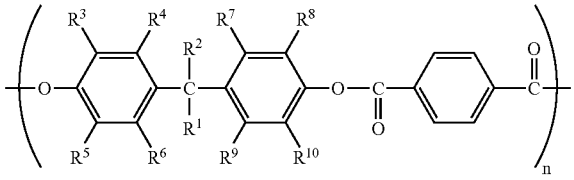

wherein $R^1$ and $R^{2'}$ are identical or different from each other, and are selected from a hydrogen atom, an alkyl group having 1 to 8 carbon atoms, a cycloalkyl group, a substituted cycloalkyl group having at least one substituent, an aryl group and an aryl group having at least one substituent;

wherein $R^1$, $R^2$, and a carbon atom that bonds to both $R^1$ and $R^2$, form a cyclic structure that is bonded to no more than two arylene groups;

wherein $R^3$ through $R^{10}$, are identical or different from each other, and are selected from a hydrogen atom, an alkyl group having 1 to 8 carbon atoms, a fluorine atom, a chlorine atom and a bromine atom; and wherein m and n satisfy the equation $0.55 \leqq m/(m+n) \leqq 0.65$; and drying the liquid coating to provide said photosensitive layer.

6. The method according to claim 5, further comprising the step of utilizing the photoconductor for electrophotography manufactured thereby in a charging process using a contact charging roller.

7. The method according to claim 5, further comprising the step of utilizing the photoconductor for electrophotography manufactured thereby in a liquid developing process.

8. The method according to claim 5, wherein the resin binder comprised of polyarylate resin has structural units represented by the following formula (I-2):

(I-2)

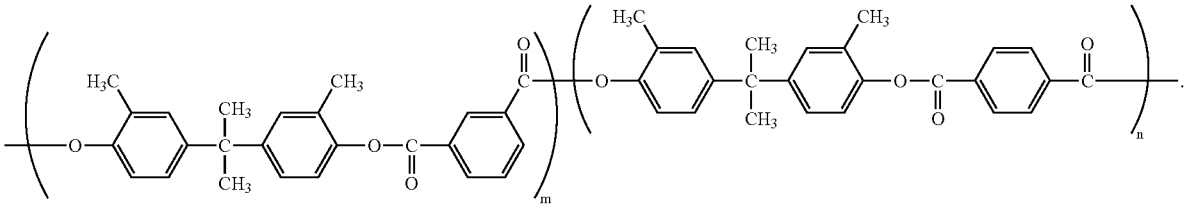

9. A method of preparing a photoconductor for electrophotography having a photosensitive layer which is a laminated layer comprised of a charge generation layer and a charge transport layer, and having resistance to solvent cracking upon exposure to at least one of liquid developers and cleaning solvents, the method comprising the steps of:

preparing a conductive substrate;

applying a charge generation layer comprised of a charge generation material to the conductive substrate;

applying to the charge generation layer a liquid coating comprised of a charge transport material and a resin binder comprised of polyarylate resin having structural units represented by formula (I):

(I)

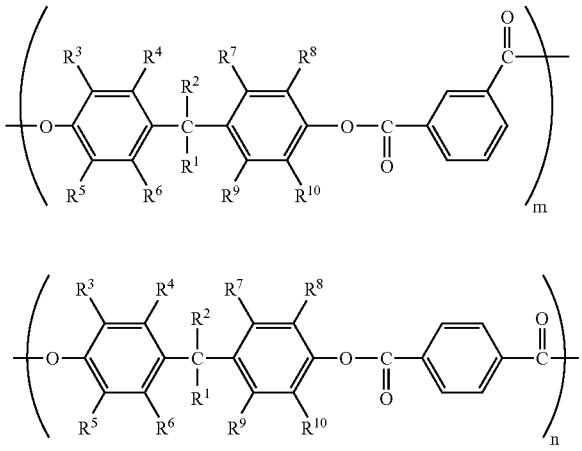

wherein $R^1$ and $R^2$, are identical or different from each other, and are selected from a hydrogen atom, an alkyl group having 1 to 8 carbon atoms, a cycloalkyl group, a substituted cycloalkyl group having at least one substituent, an aryl group and an aryl group having at least one substituent;

wherein $R^1$, $R^2$, and a carbon atom that bonds to both $R^1$ and $R^2$, form a cyclic structure that is bonded to no more than two arylene groups;

wherein $R^3$ through $R^{10}$, are identical or different from each other, and are selected from a hydrogen atom, an alkyl group having 1 to 8 carbon atoms, a fluorine atom, a chlorine atom and a bromine atom; and wherein m and n satisfy the equation $0.55 \leqq m/(m+n) \leqq 0.65$; and drying the liquid coating to provide said charge transport layer.

10. The method according to claim 9, further comprising the step of utilizing the photoconductor for electrophotography manufactured thereby in a charging process using a contact charging roller.

11. The method according to claim 9, further comprising the step of utilizing the photoconductor for electrophotography manufactured thereby in a liquid developing process.

12. The method according to claim 9, wherein the resin binder comprised of polyarylate resin has structural units represented by the following formula (I-2):

(I-2)

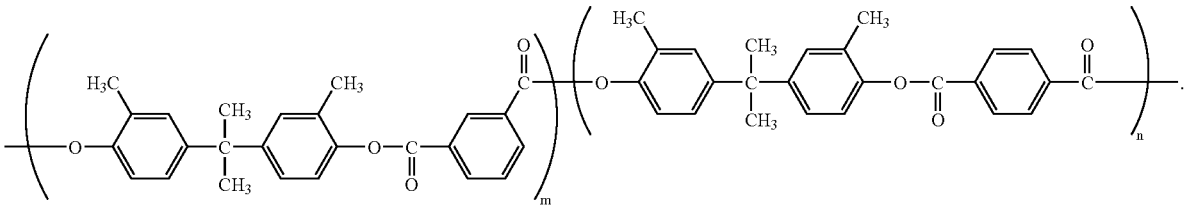

13. The process of development of an electrophotographic image on a photoconductor having a photosensitive layer which is a single layer and which has resistance to solvent cracking upon exposure to at least one of liquid developers and cleaning solvents during recycling of the photoconductor, the process comprising:

a. preparing said photoconductor for electrophotography, comprising:

(i.) a conductive substrate; and (ii.) a charge generating material, a charge transport material, and a resin binder comprised of polyarylate resin having structural units represented by formula (I):

(I)

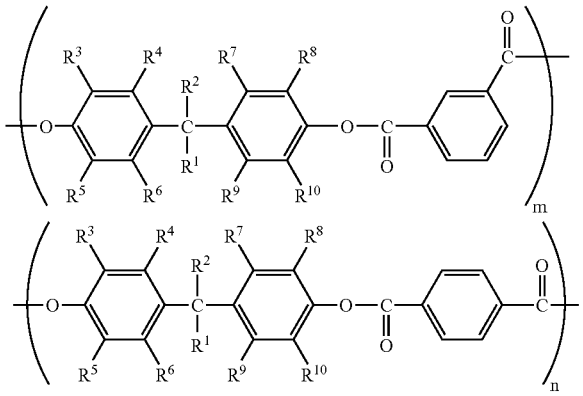

wherein $R^1$ and $R^2$, are identical or different from each other, and are selected from a hydrogen atom, an alkyl group having 1 to 8 carbon atoms, a cycloalkyl group, a substituted cycloalkyl group having at least one substituent, an aryl group and an aryl group having at least one substituent;

wherein $R^1$, $R^2$, and a carbon atom that bonds to both $R^1$ and $R^2$, form a cyclic structure that is bonded to no more than two arylene groups;

wherein $R^3$ through $R^{10}$, are identical or different from each other, and are selected from a hydrogen atom, an alkyl group having 1 to 8 carbon atoms, a fluorine atom, a chlorine atom and a bromine atom; and wherein m and n satisfy the equation $0.55 \leqq m/(m+n) \leqq 0.65$; and b. developing an electrophotographic image on the photoconductor.

14. The process according to claim 13,wherein the resin binder comprised of polyarylate resin has structural units represented by the following formula (I-2):

15. The process of development of an electrophotographic image on a photoconductor having a photosensitive layer which is a laminated layer including a charge generation layer and a charge transport layer, and having resistance to solvent cracking upon exposure to at least one of liquid developers and cleaning solvents during recycling of the photoconductor, the process comprising steps for:

a. preparing said photoconductor for electrophotography, comprising, in the order recited:

(i.) a conductive substrate;

(ii.) a charge generation layer comprised of a charge generation material to the conductive substrate; and (iii.) a charge transport material and a resin binder comprised of polyarylate resin having structural units represented by formula (I):

(I)

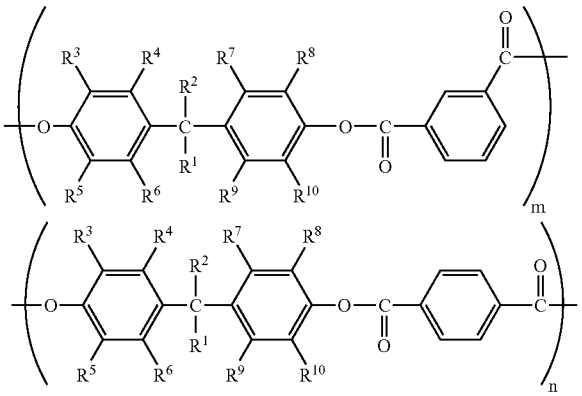

wherein $R^1$ and $R^2$, are identical or different from each other, and are selected from a hydrogen atom, an alkyl group having 1 to 8 carbon atoms, a cycloalkyl group, a substituted cycloalkyl group having at least one substituent, an aryl group and an aryl group having at least one substituent;

wherein $R^1$, $R^2$, and a carbon atom that bonds to both $R^1$ and $R^2$, form a cyclic structure that is bonded to no more than two arylene groups;

wherein $R^3$ through $R^{10}$, are identical or different from each other, and are selected from a hydrogen atom, an alkyl group having 1 to 8 carbon atoms, a fluorine atom, a chlorine atom and a bromine atom; and wherein m and n satisfy the equation $0.55 \leqq m/(m+n) \leqq 0.65$; and b. developing an electrophotographic image on the photoconductor.

(I-2)

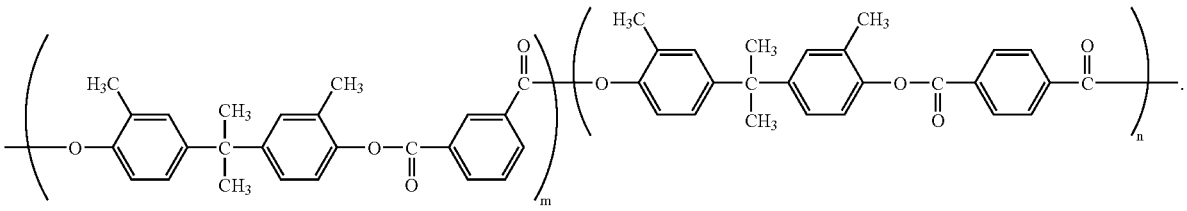

16. The process according to claim 15, wherein the resin binder comprised of polyarylate resin has structural units represented by the following formula (I-2):
(I-2)
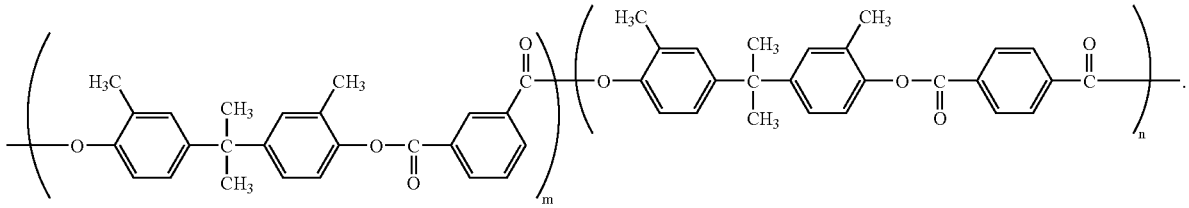
* * * * *